US006498310B1

(12) United States Patent
Bugryn

(10) Patent No.: US 6,498,310 B1
(45) Date of Patent: Dec. 24, 2002

(54) REVERSE ALARM SWITCH CIRCUIT BREAKER

(75) Inventor: James Bugryn, Bristol, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 09/909,138

(22) Filed: Jul. 19, 2001

(51) Int. Cl.[7] ..... H01H 9/00
(52) U.S. Cl. ..... 200/308; 200/303
(58) Field of Search ..... 200/17 R, 700, 200/401, 573, 293, 303, 308, 330, 331, 332, 338

(56) References Cited

U.S. PATENT DOCUMENTS 3,602,852 A * 8/1971 Brackett et al. ..... 200/303
3,720,891 A * 3/1973 Nicol ..... 335/13
3,742,402 A * 6/1973 Nicol et al. ..... 335/13
4,209,761 A * 6/1980 Klein et al. ..... 200/308
4,707,674 A * 11/1987 Harper ..... 335/13
4,760,226 A * 7/1988 Fasano ..... 200/303
4,926,148 A * 5/1990 Cambreleng ..... 200/303
5,107,236 A * 4/1992 Lesslie et al. ..... 335/132
5,264,673 A * 11/1993 Powell ..... 200/308

* cited by examiner

*Primary Examiner*—Michael Friedhofer
(74) *Attorney, Agent, or Firm*—McCormick, Paulding & Huber LLP

(57) ABSTRACT

A split housing circuit breaker having an auxiliary switch for connection to remote indicators that reflect the condition of the breaker has an actuator moveable between ON, OFF, and TRIPPED. When the actuator is moved between the ON and OFF positions, an auxiliary switch lever holds an auxiliary switch plunger against its bias to a normally-open condition for the auxiliary switch. When the actuator is in the TRIPPED position or reset to the OFF position after a fault, the plunger is allowed to extend and the auxiliary switch moves to the dosed condition. A trip lever sub-assembly includes an auxiliary switch lever that selectively acts on the plunger, a trip lever that selectively holds the auxiliary lever against the plunger, and a pin and torsion spring to rotatably interconnect the two said levers.

12 Claims, 3 Drawing Sheets

REVERSE ALARM SWITCH CIRCUIT BREAKER

FIELD OF THE INVENTION

This invention generally relates to circuit breakers having a three position actuator or handle and an auxiliary switch to provide remote indication of the circuit breaker condition. It more specifically relates to split case circuit breakers having a collapsible link and a sub-assembly that selectively engages the auxiliary switch.

BACKGROUND OF THE INVENTION

The use of an auxiliary switch in the lower or bottom wall of a split case circuit breaker is well known. See for example U.S. Pat. No. 4,760,226, where a lever is pivotally supported inside the case for moving the plunger of the auxiliary switch when the movable contact arm is in a contact-closed condition. In U.S. Pat. No. 3,742,403 an auxiliary switch is provided in the circuit breaker side wall, and is operated by a lever that is engaged by a knee portion of the collapsible link coupling the movable contact arm and the actuator. This general concept is incorporated in the present disclosure by a pair of uniquely joined plastic levers that selectively operate an auxiliary switch in the bottom of the case.

Another known feature for a split case circuit breaker is to provide for visual indication of the breaker mechanism's tripping device, that is, to visually show whether the contacts have opened due to an electrical overload. U.S. Pat. No. 3,955,162 shows such a feature in a breaker mechanism that provides for collapsing of the collapsible link whenever the circuit breaker mechanism has been electro-magnetically tripped. Circuit breaking movement of the handle/actuator is interrupted at a "center" position by a leaf spring that is carried by the handle/ actuator and that will engage the case when the collapsible link is collapsed. This '162 patent does not suggest another approach to stopping the handle or actuator at a "center" position.

A prior art breaker of the type having a collapsible link that collapses whenever the mechanism is electro-magnetically tripped employs a metal lever to operate an auxiliary switch from the collapsed link. U.S. Pat. No. 4,760,226 shows such a metal lever mounted in the metal frame of the mechanism. The prior art does not, however, show or suggest that this feature can be achieved with a non-metallic plastic lever that is not pivotally mounted to the frame. The prior art metal lever of the '226 patent is supported in the metal frame that supports the breaker mechanism creating an electrically conductive component close to the contacts and to the arc suppresser plates. The advantages of providing a plastic lever outside of and apart from the metal frame are important to meet present day dielectric criteria for circuit breakers generally.

While split case circuit breakers incorporating an auxiliary switch are known in the art, the auxiliary switch is generally designed to be normally-closed. That is, when these prior art breakers are manually switched ON or OFF, the auxiliary switch circuit remains closed. When an electrical fault occurs that trips these prior art breakers, the auxiliary switch changes to the switch-open condition. It is an object of this invention to disclose a circuit breaker that operates in the reverse manner. The auxiliary switch of the present invention remains in the normally-open condition when the circuit breaker is manually switched ON or OFF, and subsequently moves to the switch-closed condition when the circuit breaker undergoes an electrical fault. The present invention also maintains the auxiliary switch in the switch-open condition when the breaker is reset, but not when the actuator is manually moved from the ON to OFF position.

In a product currently marketed by the assignee hereof, Carling Technologies Inc., of Plainville, Conn., U.S.A., an auxiliary switch is operated by a bellcrank or L-shaped plastic lever that has one arm that acts as the auxiliary switch lever, and a second arm that is selectively engaged by the collapsible link mechanism to provide remote readout indication for the circuit breaker (e.g. tripped or not tripped only). Carling Technologies sells this unit as its "C-Series Trip Alarm Circuit Breaker".

SUMMARY OF THE INVENTION

In accordance with the present invention, a circuit breaker assembly is provided comprising a housing, an electrical contact mounted on a contact arm that is moveable between contact-open and contact-closed conditions and biased to the contact-open condition, and an actuator selectively moveable between ON and OFF positions. The circuit breaker further includes a toggle mechanism that couples the actuator to the contact arm such that when the actuator is moved to the ON position, the contact arm is moved to the closed-contact condition. A trip subassembly is further included that has an auxiliary switch lever and a trip lever hingedly connected to each other, and an auxiliary switch changeable between switch-open and switch-closed conditions. This auxiliary switch is biased to the switch-open condition and is further connectable to a remote indicator. The auxiliary switch lever acts on the auxiliary switch when the actuator is moved either from the OFF to ON or from the ON to OFF positions.

The following describes general aspects of the preferred embodiment. When the circuit breaker actuator is moved to the ON position, the contact arm acts through the auxiliary switch lever to place the auxiliary switch in a switch-open condition. When the actuator is then moved to the OFF position, pressure on the auxiliary switch lever from the contact arm is released and the circuit breaker contacts open, but the trip lever holds the auxiliary switch lever against the auxiliary switch to keep it in the switch-open condition. Conversely, when the circuit breaker trips, the trip lever is mechanically pushed away by linkage connected to the actuator. The auxiliary switch lever cannot itself overcome the bias of the auxiliary switch, which consequently changes to the switch-closed condition. This switch-closed condition is maintained even when the actuator is reset (i.e. manually moved from the TRIPPED position back to the OFF position).

DETAILED DESCRIPTION OF THE PREFERRED EMBODIMENT

Figure 1:
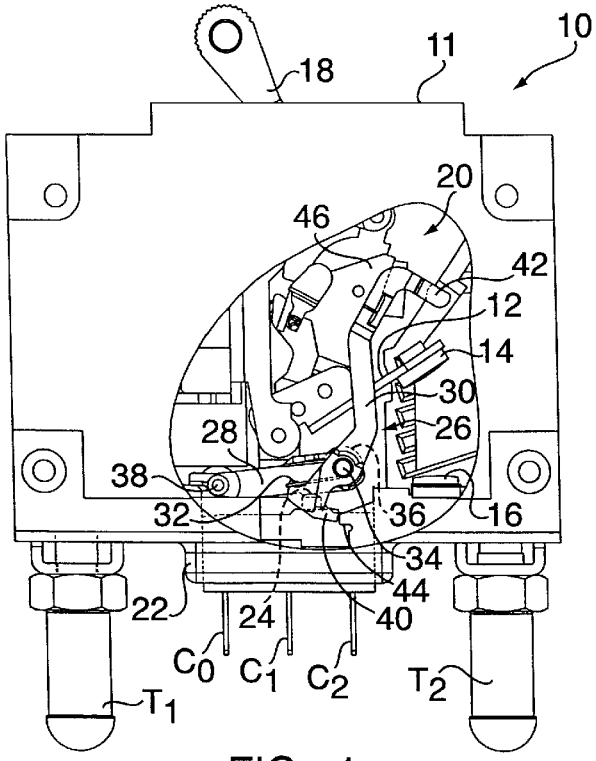
FIG. 1 is a partial cutaway view of the preferred embodiment when the breaker is tripped and the contacts open with the actuator in its reset position.

Turning now to the drawings in greater detail, FIG. 1 shows a circuit breaker 10 having a split housing 11 wherein the partial cutaway view reveals the components relevant to the present invention. The internal configuration of the circuit breaker 10 not herein specified may be any of the numerous configurations known in the art. In this preferred embodiment, those components not shown or otherwise described herein are deemed similar to those described in U.S. Pat. No. 4,760,226 entitled "SPLIT-CASE CIRCUIT BREAKER WITH MULTI PURPOSE WELL" issued Jul. 26, 1988. The '226 patent is assigned to the assignee herein and is hereby incorporated by reference. The circuit breaker 10 comprises terminals $T_1$ and $T_2$, wherein $T_1$ maintains electrical contact with a movable contact arm 12 and a first contact 14, and $T_2$ maintains electrical contact with a fixed second contact 16. The movable contact arm 12 is normally biased away from the second contact 16, as shown in FIG. 1. A manual actuator 18 moveable between ON, OFF and TRIPPED positions is mechanically linked to the movable contact arm 12 through a toggle mechanism 20. Alternatively, this toggle mechanism 20 may be any of the collapsible links known in the art. FIG. 1 shows the circuit breaker in its reset position, wherein the actuator 18 is moved to the OFF position after an electrical fault. The movable contact arm 12 is biased away from the second contact 16 as shown to define a space between the first 14 and second 16 contacts, thus leaving the resulting circuit open. This view illustrates the unit's "trip free" feature.

Incorporated into the bottom of the circuit breaker is an auxiliary switch 22 for providing remote indication of the circuit breaker's condition. The internal mechanism of the auxiliary switch may be similar to that shown in the '226 patent or any of the prior art auxiliary switches. This auxiliary switch 22 comprises a plunger 24 that is normally biased toward the actuator 18, and a series of contacts $C_0$, $C_1$, and $C_2$ protruding through the bottom of the circuit breaker case 11. The position of the plunger determines whether contact is made within the auxiliary switch between $C_0$ and $C_1$, or between $C_0$ and $C_2$, each condition being mutually exclusive. The bias of the plunger 24 is sufficient to overcome the weight of a trip sub-assembly 26 (shown in FIGS. 2 and 3) resting substantially upon it.

Figure 2:
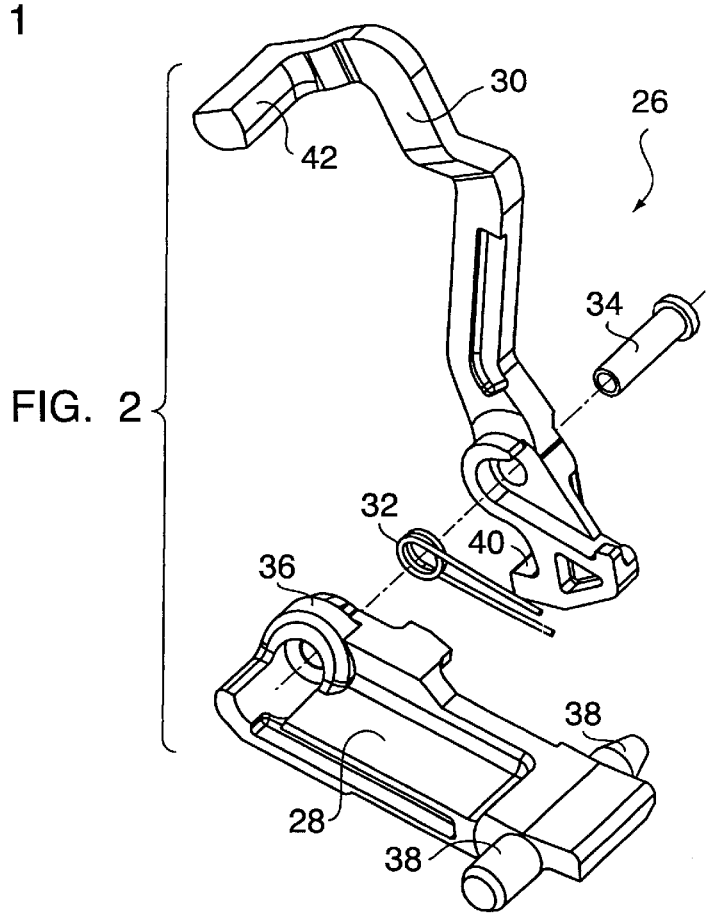
FIG. 2 is an exploded view of the trip sub-assembly components.
Figure 3:
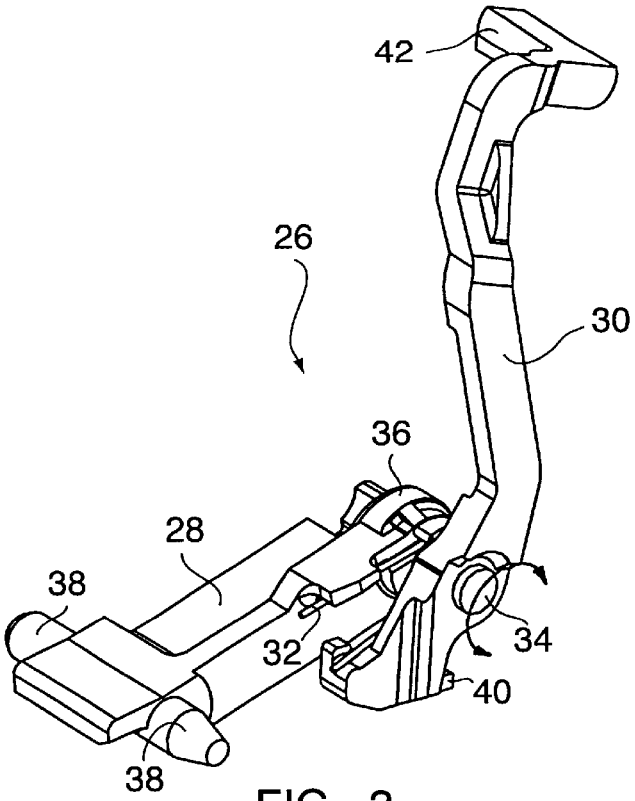
FIG. 3 shows the assembled components of the trip sub-assembly.

FIGS. 2 and 3 show the trip sub-assembly 26 in isolation for better understanding of its functional aspects. FIG. 2 shows the trip sub-assembly 26 in exploded view wherein an auxiliary switch lever 28 is hingedly joined to a trip lever 30 via a torsion spring 32 and a pin 34 that secures them together. The auxiliary switch lever 28 defines a raised surface 36 and an axle 38; and the trip lever 30 defines a hook 40 and a projection 42. The function of these items 36, 38, 40 and 42 will be later described. FIG. 3 shows the assembled trip sub-assembly 26 wherein the trip lever 30 and the auxiliary switch lever 28 are rotatable about the pin 34. FIG. 3 further indicates that the trip lever 32 and the auxiliary switch lever 28 act on each other via the torsion spring 32 at least within a limited arc length.

Figure 4:
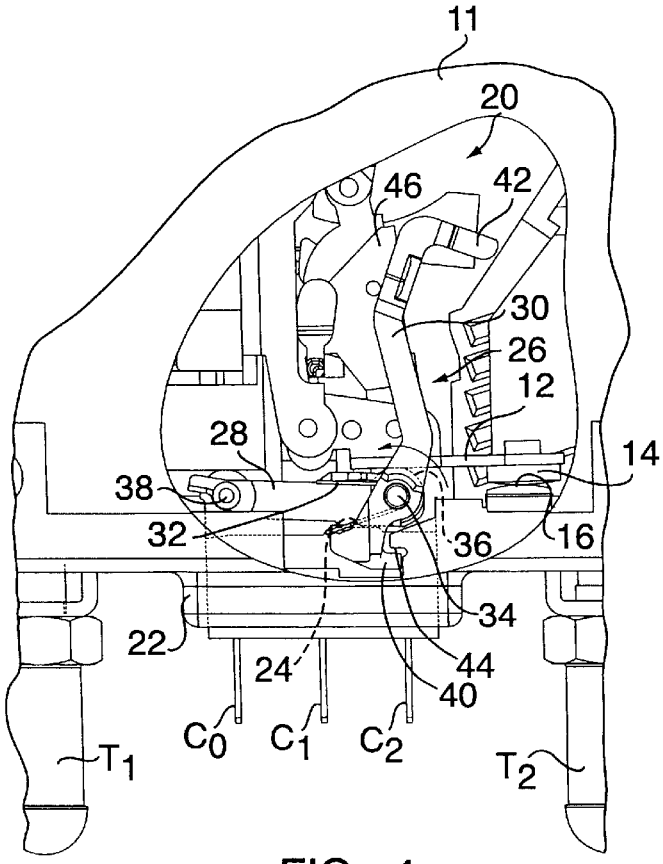
FIG. 4 is a view similar to FIG. 1 but wherein the actuator is in the ON position and the contacts are closed.
Figure 5:
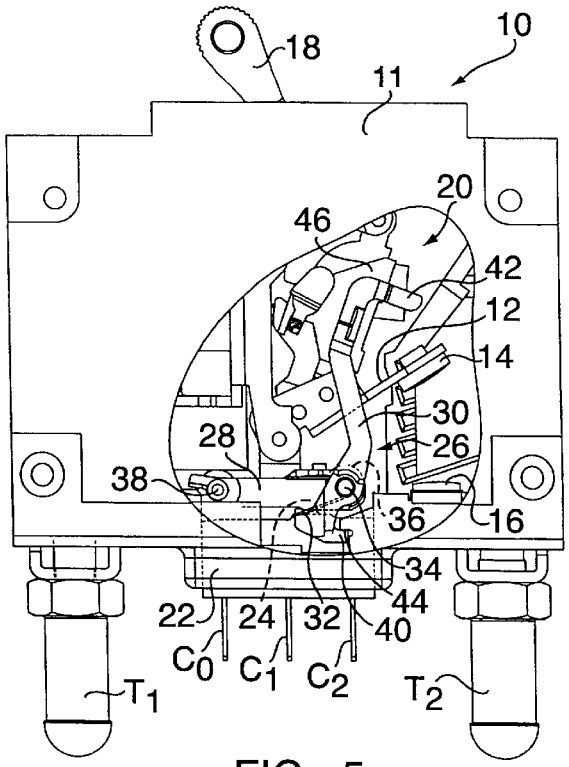
FIG. 5 is a view similar to FIG. 1 wherein the actuator has been moved to the OFF position and the contacts are open.
Figure 6:
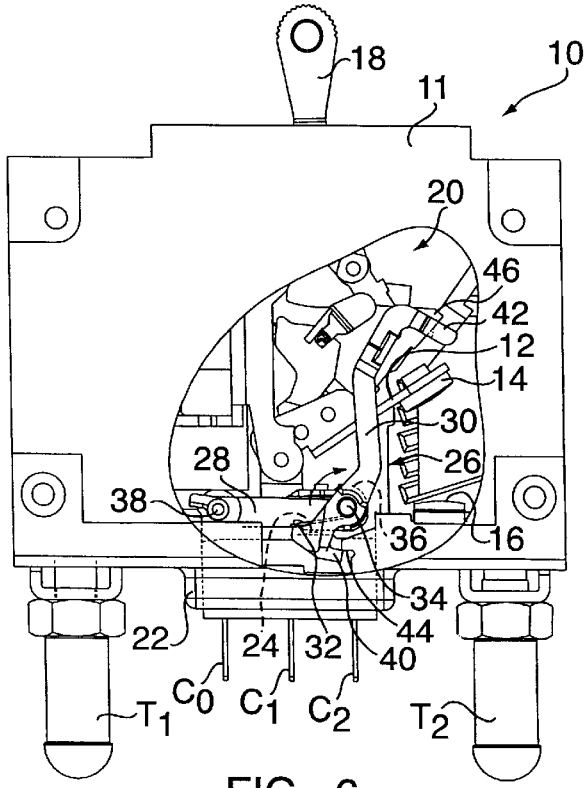
FIG. 6 is a view similar to FIG. 1 but wherein an electrical fault has tripped the breaker, causing the contacts to open and the actuator to move to the TRIPPED position.

Operation of the circuit breaker is depicted in FIGS. 4 through 6, each showing the workings of the internal components at different positions of the actuator 18. For each of these figures as well as FIG. 1, the trip sub-assembly 26 is pivotally mounted in the circuit breaker case 11 and rotates about the axle 38.

FIG. 4 details operation when the actuator is placed to the ON position, the closed-contact condition for the circuit breaker. The toggle mechanism 20 directly links the actuator 18 with the moveable contact arm 12, driving it primarily downward to close the space between the first 14 and second 16 contacts. The movable contact arm 12 impinges upon the raised surface 36 resulting in two distinct movements of the trip sub-assembly. First, the auxiliary switch lever 28 rotates clockwise about the axle 38 resulting in a primarily downward movement at the area of the pin 34. This primarily downward movement causes the auxiliary switch lever 28 to overcome the bias of the plunger 24, depressing it and changing the state of the auxiliary switch to its usual or normal switch-open position. Second, the primarily downward movement of the pin 34 has two effects: the torsion spring 32 exerts a rotation force (arrow depicted) on the trip lever 30 and the entire trip lever 30 is driven lower. Once the trip lever 30 moves low enough the hook 40 moves under an engagement area 44 through the slight rotation of the trip lever 30 about the pin 34. The engagement area 44 is a fixed protrusion of the circuit breaker split housingl 1. A space is typically defined between the hook 40 and the engagement area 44 when the actuator 18 is manually placed in the ON or closed-contact position. This is because the vertical position of the trip lever 30 is determined by how far the contact arm 12 has driven down the raised surface 36 of the auxiliary switch lever 28 (and consequently the pin 34).

During manual operation when the actuator 18 is moved from the ON position of FIG. 4 to the OFF position of FIG. 5, the auxiliary switch remains in the normal switch-open condition with the plunger 24 retained in its depressed position. Movement of the actuator 18 from the ON to the OFF position releases pressure from the toggle mechanism 20 on the contact arm 12, allowing the bias of the contact arm 12 to define a space between the contacts 14 and 16. This necessarily defines a space between the contact arm 12 and the raised surface 36 of the auxiliary switch lever 28. The bias of the plunger 24 presses upon the auxiliary switch lever 28 but can only raise it until the hook 40 of the trip lever 30 abuts the engagement area 44 of the housing. This rise is designed to be minimal and insufficient to change the condition of the auxiliary switch. Thus, the plunger 24 remains depressed and the auxiliary switch lever 28 remains in the switch-open condition, just as when the actuator is placed to the ON position.

When an electrical fault occurs that causes the circuit breaker to trip, the actuator 18 automatically moves toward the TRIPPED position, as shown in FIG. 6. In this situation, the toggle mechanism 20 collapses, driving a U-link 46 to forcibly impact against the projection 42 of the trip lever 30. This impact is sufficient to overcome both the counter-clockwise force of the torsion spring 32 on the trip lever 30 and the friction between the hook 40 and the engagement area 44, resulting in a slight clockwise rotation of the trip lever 30 about the pin 34. This clockwise rotation clears the hook 40 from under the engagement area 44, the precise transient position being depicted in FIG. 6. Once the hook 40 clears the engagement area 44, the bias of the plunger 24 rotates the auxiliary switch lever slightly counter-clockwise about the axle 38, driving the pin 34 primarily upward toward the actuator 18. As previously noted, the mere weight of the trip sub-assembly 26 is insufficient to overcome the bias of the plunger 24, so the plunger 24 moves to its extended position and the auxiliary switch moves to the switch-closed condition. A remote sensor in the same sub-circuit with the auxiliary switch will thus indicate the presence of a tripped condition for the circuit breaker.

In order to place the circuit breaker back in operation, the actuator must be reset or moved from the TRIPPED to the OFF position, which resets the toggle mechanism 20. When this is occurs, the arrangement of the internal components and the condition of the auxiliary switch are as shown in FIG. 1. The bias of the moveable contact arm 12 defines a space between the contacts 14 and 16, the hook 40 is not constrained by the engagement area 44, the plunger 24 is extended, and the auxiliary switch remains in the switch-closed condition until the actuator 18 is manually moved.

Although the invention has been shown and described in preferred embodiments, it should be understood that numerous modifications can be made without departing from the spirit and scope of the present invention. Accordingly, the present invention has been shown and described by way of illustration rather than limitation.

What is claimed is:

1. A circuit breaker assembly comprising:

a housing;

a contact arm having a contact thereon, said contact arm moveable between contact-open and contact-closed conditions;

biasing means urging said contact arm to said contact-open condition;

an actuator selectively moveable between ON and OFF positions and further having a TRIPPED position;

a toggle mechanism coupling said actuator to said contact arm for manually moving said contact arm to said contact-closed condition when said actuator is in said ON position;

a trip sub-assembly having an auxiliary switch lever and a trip lever hingedly connected to each other;

said auxiliary switch lever pivotally mounted within said housing, and said trip sub-assembly including biasing means to rotatably bias said auxiliary switch lever and said trip lever in opposing directions;

an auxiliary switch connectable to a remote indicator, said auxiliary switch changeable between switch-open and switch-closed conditions and biased to said switch-open condition;

said auxiliary switch lever acting on said auxiliary switch when said actuator is moved between the OFF and ON positions;

said auxiliary switch being in said switch-closed condition when said actuator is either in said TRIPPED position or moved from said TRIPPED position to said OFF position.

2. The circuit breaker assembly of claim 1 wherein said trip sub-assembly biasing means is a torsion spring.

3. The circuit breaker assembly of claim 1 wherein said trip lever includes a hook near one end selectively engagable with an engagement area within the housing.

4. The circuit breaker assembly of claim 3 wherein said engagement area is defined by said housing.

5. The circuit breaker assembly of claim 1 wherein said auxiliary switch includes an extendable plunger that ads to change said auxiliary switch between said switch-open and switch-closed conditions.

6. The circuit breaker assembly of claim 5 wherein said plunger is biased to extend toward said actuator.

7. The circuit breaker assembly of claim 6 whereby said auxiliary switch lever acts on said plunger to change said auxiliary switch from said switch-open to said switch-closed condition.

8. The circuit breaker assembly of claim 1 whereby said toggle mechanism mechanically impacts said trip lever when said actuator moves to the TRIPPED position.

9. The circuit breaker assembly of claim 8 wherein said toggle mechanism mechanically impacts said trip lever through a U-link.

10. The circuit breaker assembly of claim 1 wherein said housing is a split case.

11. The circuit breaker assembly assembly of claim 1 wherein said auxiliary switch and said actuator are positioned on opposing sides of said housing.

12. A circuit breaker assembly comprising:

a split case housing defining an engagement area;

a contact arm moveable between circuit-open and circuit-closed positions and biased toward the circuit-open position;

a contact mounted upon said moveable contact arm;

an actuator moveable between ON, OFF, and TRIPPED positions, said ON and OFF positions being manually selectable;

a toggle mechanism that mechanically connects said actuator with a trip subassembly;

an auxiliary switch mounted within said housing opposite said actuator, connectable to a remote indicator or sensor and being changeable between switch-open and switch-closed conditions via the position of a plunger, said plunger biased toward said actuator and said auxiliary switch biased to said switch-open condition;

said trip sub-assembly including a torsion spring, an auxiliary switch lever having a first and a second end, and a trip lever having a first and a second end, said auxiliary switch lever and said trip lever hingedly connected to each other near said first ends and said torsion spring urging rotation of said levers in opposite directions about an axis where said first ends hingedly connect;

said auxiliary switch lever first end in contact with said plunger and said auxiliary switch lever second end pivotally mounted within said housing; and said trip lever having a hook near its first end engagable with said engagement area of said housing and a projection near its second end engagable with said toggle mechanism.

* * * * *

UNITED STATES PATENT AND TRADEMARK OFFICE

CERTIFICATE OF CORRECTION

PATENT NO. : 6,498,310 B1
DATED : December 24, 2002
INVENTOR(S) : James Bugryn

It is certified that error appears in the above-identified patent and that said Letters Patent is hereby corrected as shown below:

Title page,
Item [57], ABSTRACT,
Line 10, "dosed" should read -- closed --.

Column 5,
Line 56, "ads" should read -- acts --.

Signed and Sealed this

Eleventh Day of March, 2003

JAMES E. ROGAN
*Director of the United States Patent and Trademark Office*